US005334042A

United States Patent [19]

Chevalier

[11] Patent Number: 5,334,042

[45] Date of Patent: Aug. 2, 1994

[54] ELECTRICAL CORD CONNECTING APPARATUS

[76] Inventor: Robert K. Chevalier, 836 Grassy Hill Rd., Orange, Conn. 06477

[21] Appl. No.: 851,619

[22] Filed: Mar. 16, 1992

[51] Int. Cl.[5] ..... H01R 13/62

[52] U.S. Cl. ..... 439/369; 439/368

[58] Field of Search ..... 439/369, 367, 501, 531, 439/370, 368, 371

[56] References Cited

U.S. PATENT DOCUMENTS

| | | | |
|---|---|---|---|
| 2,720,633 | 10/1955 | Westberg | 439/369 |
| 2,761,109 | 8/1956 | Hacker | 439/369 |
| 3,029,408 | 4/1962 | Anderson | 439/369 |
| 3,183,470 | 5/1965 | Hale | 439/369 |
| 3,609,638 | 9/1971 | Darrey | 439/369 |

*Primary Examiner*—Larry I. Schwartz
*Assistant Examiner*—Hien D. Vu
*Attorney, Agent, or Firm*—John J. Daniels

[57] ABSTRACT

An electrical cord connecting apparatus for maintaining the connection between a plug and socket. A plug of a portion of electrical cord is held at a first end of a supporting member and a socket of another portion of electrical cord is held at a second end of the supporting member. The supporting member is shaped such that the plug and socket are held at positions which are effective to hold the plug adjacent to the socket in an engaged position with the plug inserted in the socket. The plug end portion or the socket end portion of an electrical cord is clipped onto and retained at one end of the supporting member and the corresponding other of the plug end or the socket end portion of either the same electrical cord (when the device is used to facilitate handling of the electrical cord) or another electrical cord (when the device is used to maintain the effective coupling between the plug and socket) is clipped onto and retained by the other end of the supporting member. The present invention is effective for use with cords of varying size and shapes. Also, the present invention is effective to facilitate storage and transportation of electrical cords.

9 Claims, 5 Drawing Sheets

ELECTRICAL CORD CONNECTING APPARATUS

BACKGROUND OF THE INVENTION

The present invention pertains to an electrical cord connecting apparatus. More particularly, the present invention pertains to an electrical cord connecting apparatus which securely maintains a connection between the terminating ends of two portions of electrical cord. For example, an engaged plug and socket.

Extension cords are well known devices for supplying power from an electrical supply outlet to any of a myriad of electrically driven apparatuses. For example, in the construction industry, an electric drill is typically supplied with an electric power supply cord having a length of between three to five feet. This length has obvious limitations and is substantially inadequate to provide the required degree of freedom and mobility necessary for a worker to effectively use the drill. Therefore, it is common practice to include an electrical extension cord to electrically link the tool, or drill, to the electrical supply source (i.e. wall outlet). This electrical extension cord provides the added degree of mobility and freedom of movement to allow effective use of the electric drill.

Often times, however, the connection between the terminating end of the drill cord and the terminating end of the extension cord become a source of frustration, inefficiency and a safety hazard for the worker. This is because the nature of the connection between the plug and socket end of the cords is susceptible to easy disengagement, which results in loss of power to the drill or tool. This disengagement requires that the worker stop working and reconnect his tool with the electrical extension cord. Particularly, when a worker is working, for example on a ladder, the weight of the extension cord is enough to separate the connection. This results in much frustration and requires the worker to climb down off the ladder, reconnect the cord, and again be subjected to the same problem when he climbs back up on the ladder.

To alleviate this problem, it is common practice for a worker to form a knot in the two cords (the tool's electric cord and the extension cord) at the connecting site between the plug and socket. The use of this knot is intended to prevent disconnection between the plug and socket. However, this has a substantial drawback in that the knot creates sharp angles in the electrical cords, particularly at the point of fixation of the electrical cord with its terminating plug or socket member. These sharp angles are the source of fraying and deterioration of the electrical cord, eventually destroying the use of the cord and creating a potentially hazardous situation. Also, this tying method is ineffective because often the knot works its way out during the use and movement of the tool.

Furthermore, to store electrical cords it is common practice to coil the cord up in a series of loops having equal circumference so as to form a "donut" shaped coil. Then, it is common to take one of the terminating ends of the electrical cord and pass it around the cross sectional perimeter of the coil in a number of windings so as to prevent the coil from becoming undone. However, this practice is typically ineffective because the winding of electrical cord becomes undone resulting in the coil of electrical cord becoming tangled. Also, if the electrical cord has any substantial length, the cross sectional diameter of the "donut" shaped coil becomes too wide to be easily grasped by a human hand. This makes transportation of the cord difficult and further encourages the separation and entanglement of the electrical cord.

U.S. Pat. No. 3,097,034, issued to Jamrosy, attempts to alleviate the drawbacks associated with retaining connected electrical cords. This patent discloses a retention device of a spring type for an electrical cord terminal connector. However, among other drawbacks, this patent discloses a device which is relatively complicated, is not easily retrofitted to existing electrical cords, and is dangerous to use due to its inherent conductive nature.

SUMMARY OF THE INVENTION

It is an object of the present invention to alleviate the drawbacks of the prior art. In accordance with the present invention, an inventive electrical cord connecting apparatus is provided which effectively maintains the coupled connection of a plug and socket of portions of electrical cords using an inexpensive, easy to fabricate, and highly effective device. It is another object of the present invention to provide an electrical cord connecting apparatus which is adaptable for use for securing the plug and socket connection between round cross section cords of varying diameter, and/or rectangular cross section cords of varying thickness, or any combination thereof.

In accordance with the present invention, an electrical cord connecting apparatus is provided which comprises a supporting member. The supporting member is preferably made from a flexible and durable material, such as a polymer, rubber, or plastic, but may be made from any suitable material, such as metal, ceramic, or the like. Holding means are disposed on the supporting member for holding a plug of a plug end of a portion of electrical cord. The holding means are also provided for holding a socket of a socket end of another portion of electrical cord. The supporting member is shaped such as the holding means disposed on it hold the respective plug and socket at a position which is effective to hold the plug adjacent to the socket in an engaged position with the plug inserted in the socket. The holding means preferably comprises first clipping means disposed at a first end of the supporting member for clipping onto and retaining either of the plug end portion or the socket end portion of an electrical cord. Second clipping means are also disposed on the supporting member at a second end for clipping onto and retaining the other of the plug end and socket end portion of either the same electrical cord (when the device is used to facilitate handling of the electrical cord) or another electrical cord (when the device is used to maintain the effective coupling between the plug and socket).

In accordance with one embodiment of the present inventive electrical cord connecting apparatus, the first and second clipping means each include means for engaging at least one of a round cross section electrical cord and a rectangular cross section electrical cord. Thus, the present invention is effective for use with cords of varying size and shapes. Also, by selecting the dimensions of the engaging means as well as selecting the properties of the material used to form the material of the engaging means (such as the modulous of elasticity), the present electrical cord connecting apparatus can be adapted for use with a wide range of cords.

Therefore, for example, a three wire retangular electrical cord may be securely coupled with a round cross sectional electrical cord, or any of a multitude of combinations of cords.

In a preferred embodiment of the present invention, the first and second clipping means each includes means for engaging with both a round cross sectional electrical cord and a rectangular cross sectional electrical cord. Thus, the preferred embodiment of the present invention provides a means for securely coupling electrical cords having the most common configuration of such cords.

BRIEF DESCRIPTION OF THE DRAWINGS

FIG. 9(*b*) is a side view of the alternative embodiment shown in FIG. 9(*a*) showing the securing means in a disengaged position; and FIG. 9(*c*) is a cut away view of the securing means shown in FIGS. 9(*a*) and 9(*b*).

DETAILED DESCRIPTION OF THE INVENTION

The following specification taken in conjunction with the drawings set forth the preferred embodiment of the present invention. A preferred embodiment of the invention is disclosed herein as the best mode contemplated by the inventor for carrying out his invention, although it should be understood that several modifications can be accomplished within the scope of the present invention.

Figure 1:
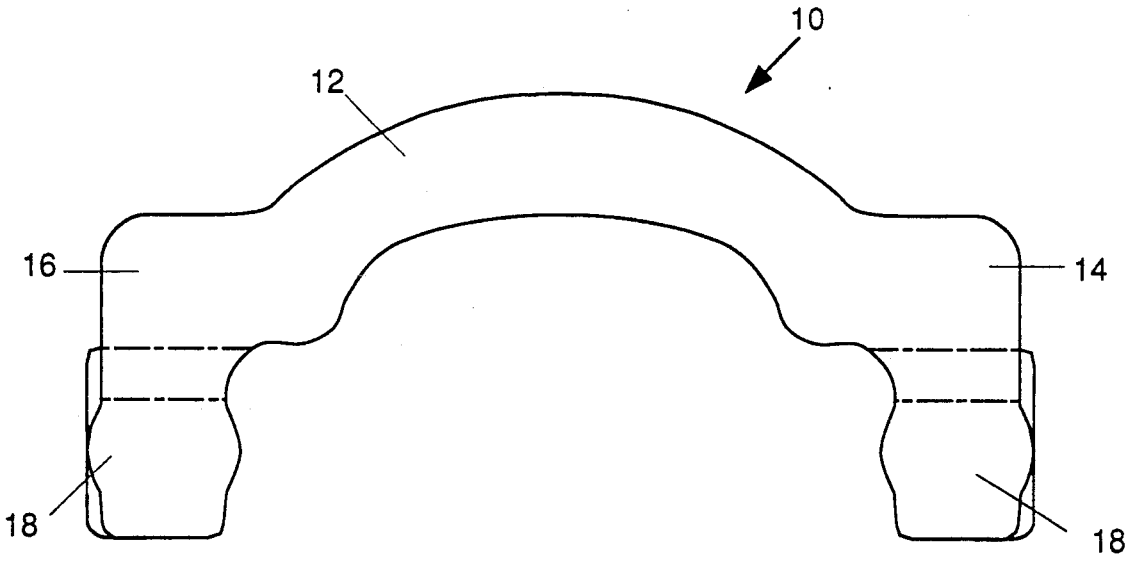
FIG. 1 is a front plan view of a preferred embodiment of the inventive electrical cord connecting apparatus.

Referring to FIG. 1, the present inventive electrical cord connecting apparatus includes a supporting member 12 which has a first end 14 and a second end 16. The inventive electrical cord connecting apparatus may be injection molded and may be comprised of a polymer, plastic, rubber, or the like and preferably have a degree of flexibility so that the inventive electrical cord connecting apparatus 10 may perform the function described below. Holding means 18 are disposed on the supporting member 12 for holding the plug of a portion of electrical cord and for holding the socket of another portion of electrical cord. Depending on the use of the inventive electrical cord connecting apparatus 10, the plug may be from a first electrical cord and the socket may be from a second electrical cord which are intended to be linked together using the inventive electrical cord connecting apparatus 10. Alternatively, as will be described with reference to FIGS. 7 and 8 below, the plug and socket may be a part of the same electrical cord in which case the electrical cord connecting apparatus 10 is used to facilitate storage and carrying of the electrical cord.

Figure 2:
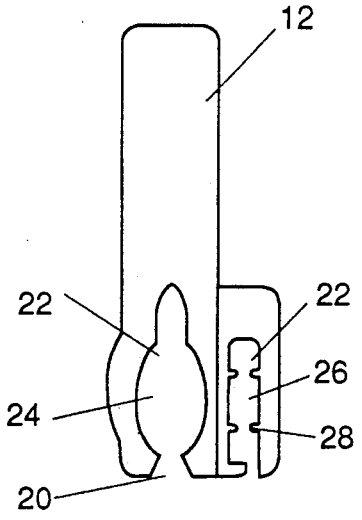
FIG. 2 is a side view of the embodiment of the inventive electrical cord connecting apparatus shown in FIG. 1.

The holding means 18 is effective to position and hold the plug adjacent to the socket in an engaged position with the plug inserted in the socket. As shown in FIG. 2, the holding means 18 preferably comprises at least one clipping means 20 which is disposed at either the first end 14, the second end 16 or both ends of the supporting member 12. The clipping means 20 is for clipping onto and retaining the plug end portion and/or the socket end portion of the electrical cord. The clipping means 20 preferably includes engaging means 22 defining a first aperture 24 and/or a second aperture 26 for engaging with at least one of a round cross sectional electrical cord and a rectangular cross sectional electrical cord. In the case of the rectangular cross sectional electrical cord, the engaging means 22 includes groove receiving bumps 28 which are effective to receive grooves disposed on the rectangular cross section electrical cord.

Figure 3:
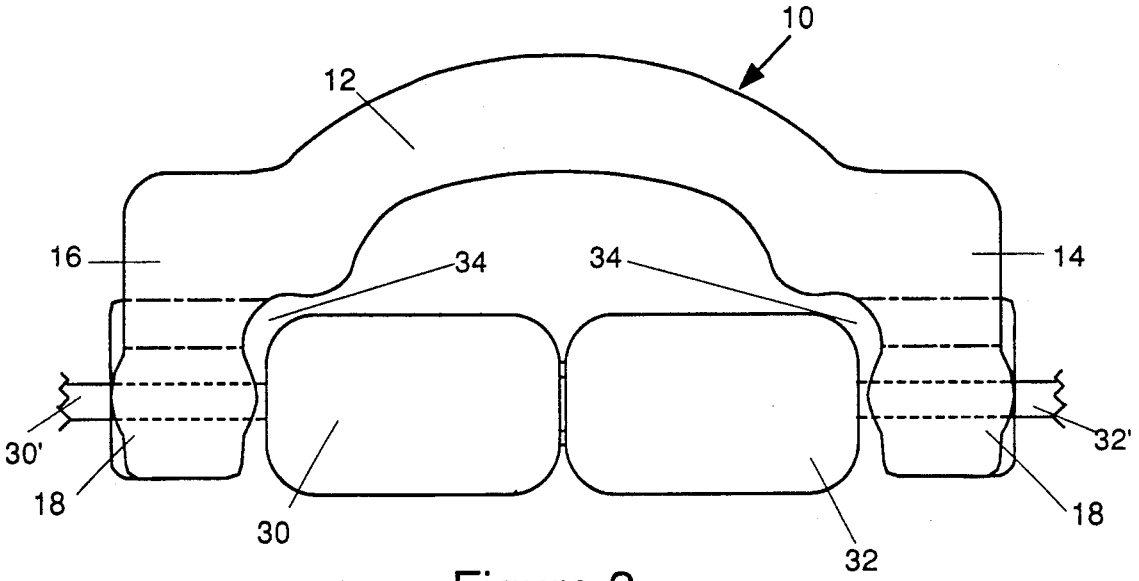
FIG. 3 is a front plan view of the preferred embodiment of the inventive electrical cord connecting apparatus shown in use.
Figure 4:
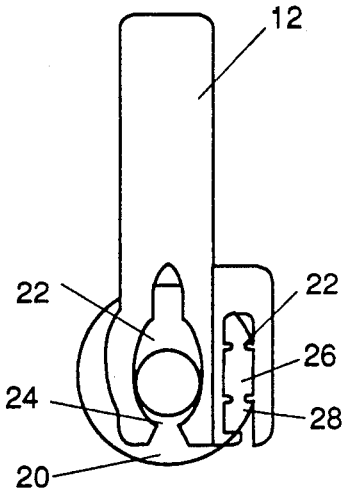
FIG. 4 is a side view of the preferred embodiment of the inventive electrical cord connecting apparatus shown in use clamping a round cross section electrical cord.
Figure 5:
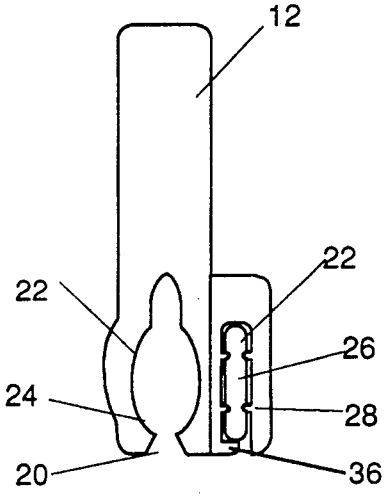
FIG. 5 is a side view of the preferred embodiment of the inventive electrical cord connecting apparatus shown in use clamping a rectangular cross section electrical cord.

Referring now to FIGS. 3 through 5, the function and use of the inventive electrical cord connecting apparatus 10 will be described. In accordance with the preferred embodiment, clipping means 20 are disposed at the first end 14 and the second end 16 of the supporting member. These clipping means 20 include engaging means 22 which are preferably configured to engage with a round cross section electrical cord and a rectangle cross section electrical cord. In use, the plug 30 of one portion 30' of an electrical cord is inserted into the socket 32 of another portion 32' of electrical cord. Next, the clipping means 20 disposed on the first end 14 of the supporting member 12 is clipped onto a portion of the electrical cord which terminates with the socket 32. The clipping means 20 which is disposed on the second end 16 of the supporting member 12 is clipped onto the portion of the electrical cord which terminates in the plug 30. As shown in FIGS. 3 and 4, the engaging means 22 which engages with the round cross section electrical cord engages and retains the respective portions of the electrical cords so that the plug 30 and socket 32 are disposed between the clipping means 20 as shown in FIG. 3. The holding means 18, which is comprised of the clipping means 20 disposed on the first and second end respectively, includes shoulder portions 34 which are disposed so as to be effective to prevent movement of either the plug 30 and the socket 32. Thus, if the coupled plug 30 and socket 32 experience a separating movement, either or both of the plug 30 and socket 32 abut against the respective shoulder portions 34 of the holding means 18 and are restrained from further movement. Therefore, separation of the connection between the plug 30 and socket 32 is effectively prevented.

As shown in FIG. 5, an electrical cord having a rectangular cross section typically is comprised of three adjacent sections of two live wires and one ground wire configured as shown in the drawings. The insulation surrounding these wires typically is formed so as to have grooves. In accordance with the preferred embodiment of the present invention, the engaging means 22 which receives the rectangular cross section electrical cord includes groove receiving bumps 28 which are effective to receive the groove disposed on the rectangular cross section electrical cord and thereby more securely retain the cord from movement. Furthermore, a retaining member 36 may be provided to prevent the rectangular electrical cord from slipping out of the engaging means 22 to further enhance the security of the coupled connection. It is noted that the material of the engaging means 22 may be selected so that a spring tension is applied to the electrical cord which is retained in the engaging means 22 to maintain the positioning of the plug 30 and socket 32 in the gap between the clipping means 20 disposed on the first end 14 and the second end 16 of the supporting member. Other embodiments of these engaging means 22 may included spring clips, elastic band clips, snaps, and the like (not shown).

Figures 6, 7:
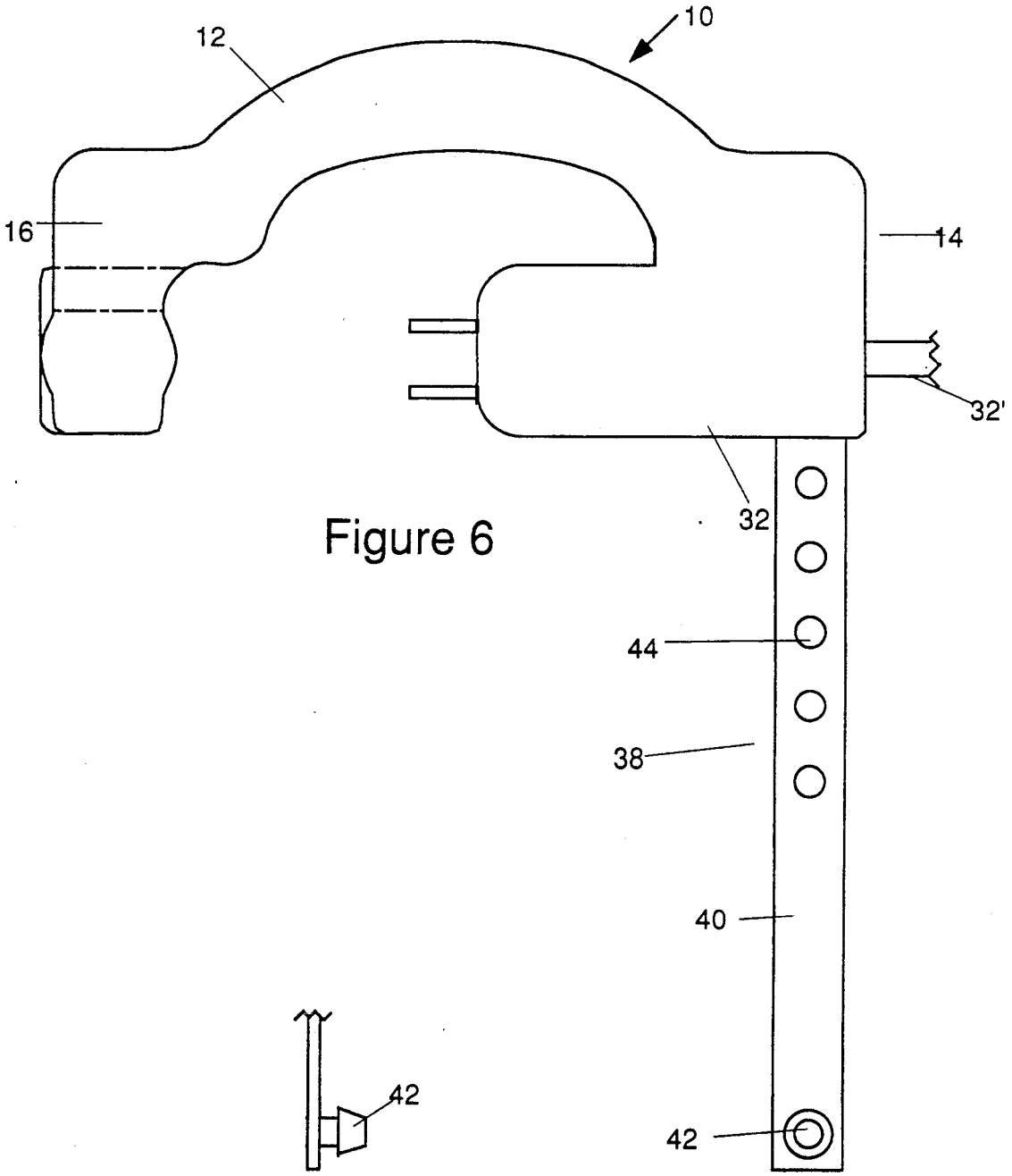
FIG. 6 is an alternative embodiment of the inventive electrical cord connecting apparatus.
FIG. 7 is an isolated view of a mushroom head of retaining means of the alternative embodiment of the inventive electrical cord connecting apparatus shown in FIG. 6.

Referring now to FIGS. 6 and 7, an alternative embodiment of the inventive electrical cord connecting apparatus 10 will be described. In accordance with this alternative embodiment, either the plug 30 or the socket 32 of the electrical cord is integrally fixed to either of the first or second end of the supporting member. As shown in FIG. 6, the socket 32 end of the electrical cord is integrally fixed to the first end 14 of the supporting member 12. This may be accomplished by forming the exterior of the socket 32 or plug 30 concurrently with the electrical cord connecting apparatus 10 using such means as injection molding. Alternatively, the plug 30 or socket 32 end may be fixedly attached to the supporting member 12 using clips, straps, clamps or the like. Furthermore, the inventive electrical cord connecting apparatus 10 may be attached to the electrical cord so that one end of the inventive electrical cord connecting apparatus 10 is slideably attached along the length of the electrical cord while the other end of the inventive electrical cord connecting apparatus 10 has the holding means 18 disposed thereon so that it can be slid into position for use in coupling the plug 30 or socket 32 end of one portion of electrical cord with the socket 32 or plug 30 end of another portion of electrical cord (not shown).

Also shown in FIG. 6 in accordance with this embodiment of the inventive electrical cord connecting apparatus 10, cord retaining means 38 is provided disposed on the supporting member 12 for retaining a coiled length of electrical cord. In this embodiment, the cord retaining means 38 comprises at least one strap member 40 which is effective for wrapping around and retaining a coiled length of electrical cord. In the embodiment shown, a mushroom head 42 (shown in FIG. 7) is disposed along the length of the strap member 40, and in use, the strap member 40 is wrapped around the coiled length of electrical cord and the mushroom head 42 is inserted into an appropriate receiving hole 44 also disposed on the strap.

Figure 8:
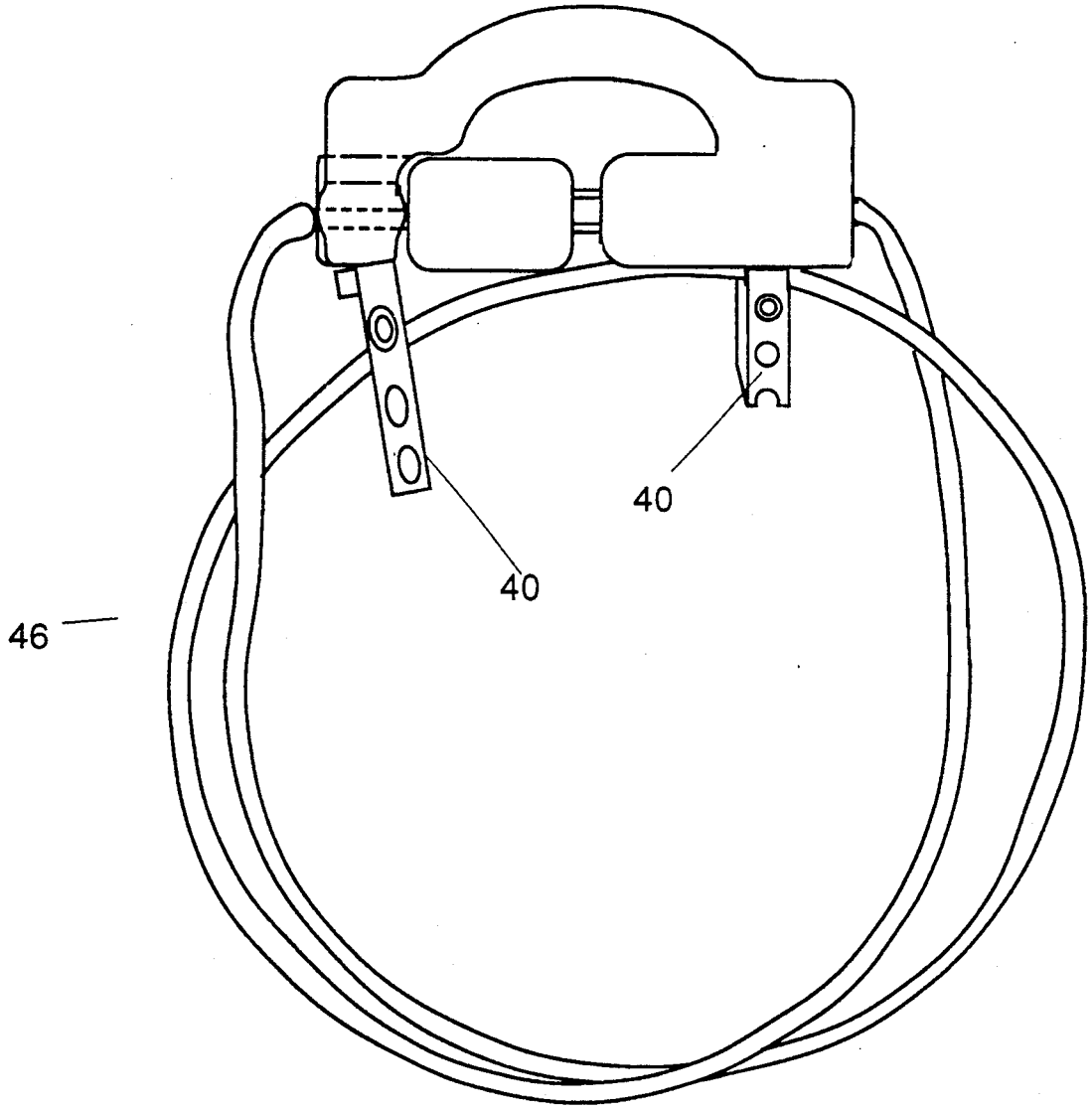
FIG. 8 is a front plan view of the alternative embodiment of the inventive electrical cord connecting apparatus shown in use retaining a coiled electrical cord.

Referring to FIG. 8, the inventive electrical cord connecting apparatus 10 is shown in use for retaining a coiled length of electrical cord 46. In this embodiment, the socket 32 end of the electrical cord is integrally fixed to the supporting member while the plug 30 end is not. To facilitate carrying of the electrical cord 46, the user coils the electrical cord 46 and inserts the portion of the electrical cord 46 near the plug 30 end in the holding means 18 disposed on the supporting member 12 after plugging the plug 30 into the socket 32. Thus, the plug 30 and socket 32 of the electrical cord are supported and held by the inventive electrical cord connecting apparatus 10. Also, by wrapping the strap or straps 40 around the coiled length of electrical cord 46 and fixing the strap or straps 40, using for example, the mushroom head 42 inserted in one of the receiving holes 44, the entire electrical cord 46 may be easily carried and stored. It is noted that the cord retaining means 38 may also be comprised of a buckle assembly, velcro, clamping means, and the like.

Figure 9A:
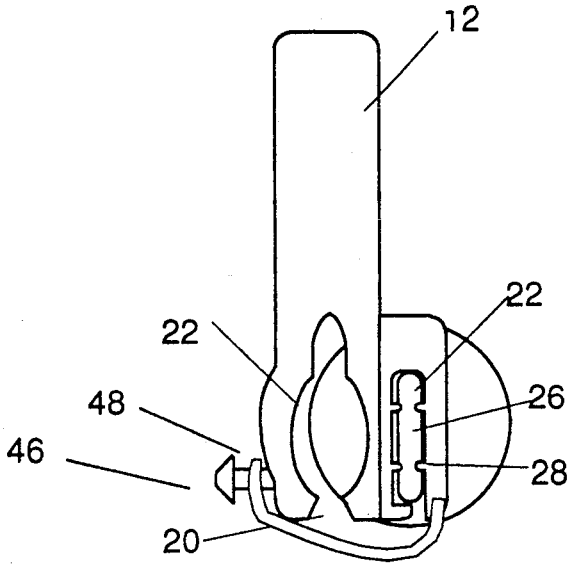
FIG. 9(*a*) is a side view of an alternative embodiment of the inventive electrical cord connecting apparatus showing securing means in use in an engaged position.
Figure 9B:
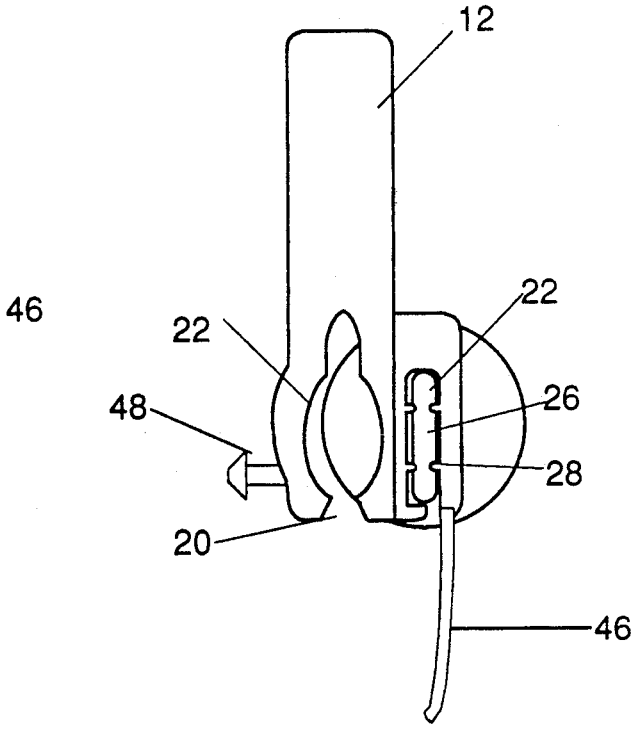
Figure 9C:
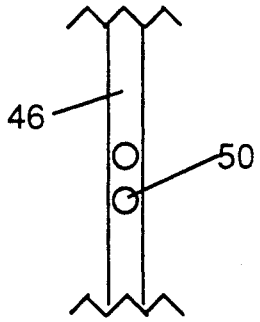

Referring to FIGS. 9(*a*) through 9(*c*), another alternative embodiment provides clamping means, including for example, securing strap 46, for applying a clamping force to a portion of electrical cord held in the clipping means 20. The securing strap 46 is depends from the exterior of the clipping means (shown in FIG. 9(*b*) in a disengaged position. In use, as shown in FIG. 9(*a*), the securing strap is drawn around the perimeter of the clipping means 20 and secured to a mushroom head 48. Thus, securing the portion of electrical cord 26 within the clipping means 20. In this embodiment, a mushroom head 48 is adapted to engage with a retaining hole 50, however, other fastening means, such as velcro, buckles, or the like may be used.

With respect to the above description, it is realized that the optimum dimensional relationships for parts of the invention, including variations in size, materials, shape, form, function, and manner of operation, assembly and use, are deemed readily apparent and obvious to one skilled in the art. All equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described. Accordingly, all suitable modifications and equivalents may be resorted to, falling within the scope of the invention.

I claim:

1. An electrical cord connecting apparatus, comprising: a supporting member having a first end and a second end; and holding means disposed on the supporting member for holding a plug end of a portion of electrical cord and for holding a socket end of an other portion of electrical cord, and effective to position and hold the plug end adjacent to the socket end in an engaged position where the plug end is inserted into the socket end, the holding means comprising first engaging means disposed at the first end and second engaging means disposed at the second end, each engaging means for engaging with and retaining a portion of electrical cord, at least one of the engaging means defining an aperture having an inlet and side walls configured and dimensioned to receive a rectangular cross section electrical cord through the inlet and engage with the side walls a portion of electrical cord, the side walls having groove receiving bumps effective to receive grooves disposed on the rectangular cross section electrical cord.

2. An electrical cord connecting apparatus according to claim 1; wherein at least one of the engaging means defines another inlet and aperture effective for engaging with a round cross section electrical cord.

3. An electrical cord connecting apparatus according to claim 2; wherein the supporting member comprises at least one of an electrically insulative polymer, rubber, and plastic having a modulous of elasticity effective for the engaging means to engage and secure round cross sectional electrical cords having different diameters and rectangular cross section electrical cords having different thicknesses; and the engaging means is configured and dimensioned to engage and secure round cross sectional electrical cords having different diameters and rectangular cross sectional electrical cords having different thicknesses.

4. An electrical cord connecting apparatus according to claim 1; wherein the supporting member comprises at least one of an electrically insulative polymer, rubber, and plastic having a modulous of elasticity effective for the engaging means to engage and secure rectangular cross section electrical cords having different thicknesses; and the engaging means is configured and dimensioned to engage and secure rectangular cross sectional electrical cords having different thicknesses.

5. An electrical cord connecting apparatus, comprising: a supporting member having a first end and a second end, the supporting member injection molded from a material comprised of at least one of an electrically insulative polymer, rubber, and plastic having a modulous of elasticity; and holding means disposed on the supporting member for holding a plug end of a portion of electrical cord and for holding a socket end of an other portion of electrical cord, and effective to position and hold the plug end adjacent to the socket end in an engaged position where the plug end is inserted into the socket end, the holding means comprising first engaging means disposed at the first end and second engaging means disposed at the second end, each engaging means defining an aperture having an inlet and side walls and configured and dimensioned to receive through the inlet and engage with the side walls a portion of electrical cord, each engaging means defining at least one of a first inlet having an aperture and side walls effective for engaging with a round cross section electrical cord and a second inlet having an aperture and side walls effective for engaging with a rectangular cross section electrical cord for clipping onto and retaining a portion of electrical cord, the side walls of the second inlet having groove receiving bumps effective to receive grooves disposed on a rectangular cross section electrical cord; whereby the modulous of the supporting member is effective provide an urging force for urging the plug end and socket end in an engaged position.

6. An electrical cord connecting apparatus according to claim 5; wherein the supporting member comprises at least one of an electrically insulative polymer, rubber, and plastic having a modulous of elasticity effective for the engaging means to engage and secure round cross sectional electrical cords having different diameters and rectangular cross section electrical cords having different thicknesses; and the engaging means is configured and dimensioned to engage and secure round cross sectional electrical cords having different diameters and rectangular cross sectional electrical cords having different thicknesses.

7. An electrical cord connecting apparatus, comprising: a supporting member having a first end and a second end; and holding means integrally formed with the supporting member and disposed on the supporting member for holding a plug end of a portion of electrical cord and for holding a socket end of an other portion of electrical cord, and effective to position and hold the plug end adjacent to the socket end in an engaged position where the plug end is inserted into the socket end, the holding means comprising a first engaging means disposed at the first end and a second engaging means disposed at the second end, the first and second engaging means each defining a round cord receiving inlet and a rectangular cord receiving inlet, each inlet having side walls and an aperture effective for engaging with a respective one of a round cross section electrical cord and a rectangular cross section electrical cord.

8. An electrical cord connecting apparatus according to claim 7; wherein each rectangular cord inlet has side walls having groove receiving bumps effective to receive grooves disposed on a rectangular cross section electrical cord.

9. An electrical cord connecting apparatus according to claim 7; further comprising either the plug end and the socket end integrally disposed with the support member at either of the first end and second end opposite the engaging means.

* * * * *